US008684568B2

(12) United States Patent
Nagaoka et al.

(10) Patent No.: US 8,684,568 B2
(45) Date of Patent: Apr. 1, 2014

(54) LED UNIT AND ILLUMINATION APPARATUS USING SAME

(75) Inventors: Shinichi Nagaoka, Niigata (JP); Yutaka Kitaguchi, Osaka (JP); Masahiko Yosida, Niigata (JP)

(73) Assignee: Panasonic Corporation, Osaka (JP)

( * ) Notice: Subject to any disclaimer, the term of this patent is extended or adjusted under 35 U.S.C. 154(b) by 150 days.

(21) Appl. No.: 13/397,925

(22) Filed: Feb. 16, 2012

(65) Prior Publication Data

US 2012/0218760 A1 Aug. 30, 2012

(30) Foreign Application Priority Data

Feb. 28, 2011 (JP) ..... 2011-042398

(51) Int. Cl.
*F21V 21/00* (2006.01)

(52) U.S. Cl.
USPC ..... 362/374; 362/249.01; 362/249.02; 362/362; 362/375

(58) Field of Classification Search
USPC ..... 362/249.01–249.02, 362, 374, 375
See application file for complete search history.

(56) References Cited

U.S. PATENT DOCUMENTS

| | | | |
|---|---|---|---|
| 2010/0265656 | A1 | 10/2010 | Yamaguchi et al. |
| 2011/0032709 | A1* | 2/2011 | Tyson et al. ..... 362/294 |
| 2012/0021656 | A1 | 1/2012 | Norris et al. |

FOREIGN PATENT DOCUMENTS

| | | | |
|---|---|---|---|
| EP | 2 345 840 | A2 | 7/2011 |
| JP | 10-324360 | | 12/1998 |
| JP | 11-340648 | | 12/1999 |
| JP | 2003-59330 | | 2/2003 |
| JP | 2008-258066 | | 10/2008 |
| JP | 2010-205645 | A | 9/2010 |
| JP | 2010-251616 | | 11/2010 |
| JP | 2010-252224 | | 11/2010 |

OTHER PUBLICATIONS

Search Report dated Feb. 27, 2013 issued in corresponding European application No. 12001062.4.

* cited by examiner

*Primary Examiner* — William Carter
(74) *Attorney, Agent, or Firm* — Bacon & Thomas, PLLC

(57) ABSTRACT

An LED unit includes a plate-shaped base; a light-emitting device placed on a surface of the base and having one or more LED chips; and a cover mounted to the base at a location above a front side of the light-emitting device and having a function to transmit light emitted from the light-emitting device. The base has on the surface thereof an annular groove for receiving a seal therein, and the cover has on a surface thereof directed to the base an annular protruding part, the annular protruding part being inserted into the annular groove to seal the base and the cover through the seal. A distance between the protruding part and the groove in a width direction of the groove is shorter in a section of the groove than the other sections of the groove.

8 Claims, 16 Drawing Sheets

LED UNIT AND ILLUMINATION APPARATUS USING SAME

FIELD OF THE INVENTION

The present invention relates to an LED unit and an lighting fixture using the LED unit.

BACKGROUND OF THE INVENTION

Conventionally, a lighting fixture having an LED unit (LED lighting fixture) has been proposed (for example, Japanese Patent Application Publication Nos. 2003-59330 and 2008-258066 (JP2003-59330A and JP2008-258066A)).

The LED lighting fixture disclosed in JP2003-59330A has an LED module board 37 on which LED chips 36, etc. are mounted, as shown in FIG. 15. On the LED module board 37, a terminal block 24 having terminals 39 used for directly connecting feeder wires 38 to the LED module board 37 is provided. In the terminal block 24, release buttons 25 for releasing the feeder wires 38 from the respective terminals 39 are provided. Further, in the LED lighting fixture having the LED module board 37, the LED chips 36, the LED module board 37, the terminal block 24 and the like constitute an LED unit.

Further, the LED lighting fixture disclosed in JP2008-258066A is, for example, a pendant light that is a lighting fixture suspended from a ceiling. As shown in FIGS. 16A and 16B, this LED lighting fixture includes an LED board 27 having LEDs 26 thereon, and a power circuit 28 for supplying electricity to the LED board 27. This LED lighting fixture further includes a cylindrical LED casing 29 having a base for holding the LED board 27, and a cylindrical power casing 30 for holding a power circuit 28. The power casing 30 is separated from the LED casing 29 and has a base. Further, the power casing 30 is placed above the LED casing 29.

In a bottom wall 30*c* of the power casing 30, there is a cord passing hole 30*d* through which a power-side cord 32 electrically connected to the power circuit 28 can pass. The distal end of the power-side cord 32 is provided with a connection plug 32*a*. Further, locking hooks 34 used for holding the LED casing 29 protrude from the lower surface of the power casing 30. The locking hooks 34 are arranged at regular intervals in a circumference direction.

An upper plate 29*a* is attached to the In the LED casing 29 to close the space defined in the LED casing 29. The upper plate 29*a* has a cord passing hole 29*b* through which an LED-side cord 33 electrically connected to the LED board 27 passes. At the leading end of the LED-side cord 33, a connection plug 33*a* that is removably connected to the connection plug 32*a* of the power-side cord 32 is provided. Further, in the upper plate 29*a*, locking holes 35 are formed correspondingly to the locking hooks 34 of the power casing 30 so that the locking hooks 34 can be engaged with the respective locking holes 35. Accordingly, the LED lighting fixture having the construction shown in FIGS. 16A and 168 can be assembled by bringing the upper plate 29*a* of the LED casing 29 into surface contact with the bottom wall 30*c* of the power casing 30. Further, in the LED lighting fixture having the construction shown in FIGS. 16A and 168, the LEDs 26, the LED board 27, the LED casing 29, the upper plate 29*a*, the LED-side cord 33 and the connection plug 33*a* constitute an LED unit.

However, considering the LED unit is used in a variety of environments, it is preferred that the LED unit be provided with a sealing structure capable of preventing moisture or impurities from being introduced into the LED unit. Here, although it is not related to an LED unit, there has been proposed, as a structure for improving the watertightness between a pair of housing bodies, a sealing structure that is a packing formed by hardening a sealing material filled in a groove of one of the pair of housing bodies with a space provided between the sealing material and one side surface of the groove by using a jig (for example, Japanese Patent Application Publication No. H11-340648 (JP11-340648A)). Another sealing structure that is formed by applying a silicone resin having a lower hardness in a groove of one of a pair of housing bodies and by applying another silicone resin having a higher hardness on the silicone resin having the lower hardness and is used as a seal between the pair of housing bodies has been proposed (for example, Japanese Patent Application Publication No. H10-324360 (JP10-324360A)). A further sealing structure that is formed by placing a separately produced annular packing in an annular groove defined in a pair of housing bodies engaged with each other has been proposed (for example, Japanese Patent Application Publication No. 2010-252224 (JP2010-252224A)). Still another sealing structure that is formed by placing spherical sealing materials in a groove of one of a pair of housing bodies has been proposed (for example, Japanese Patent Application Publication No. 2010-251616 (JP2010-251616A)).

However, in each of the sealing structures disclosed in JP11-340648A and JP10-324360A, a liquid sealing material is used. However, a long time is required to harden the sealing material after the sealing material is applied, so that it is problematic in that the long hardening time may reduce the productivity. Particularly, when the hardening time of the sealing material is too long, the housing bodies may not be appropriately sealed in desired locations due to unexpected vibration or external force applied to the housing bodies during an assembling process. Further, when the sealing material is being hardened, the sealing material may be deformed or bubbles may be formed in the sealing material so that close contact between the housing bodies that are to be sealed by the sealing material may not be accomplished. Further, in the sealing structure disclosed in JP2010-252224A in which the annular packing is used to seal the housing bodies, a period of time is required to place the annular packing in the groove of the housing bodies, thereby resulting in a poor productivity. Further, when the annular packing is not precisely placed at a predetermined location in the groove of the housing body or the packing is placed in the groove in a deformed state, desired watertightness of the packing may not be accomplished. Further, in the sealing structure using the spherical sealing materials disclosed in JP2010-251616A, it is necessary to place a predetermined number of spherical sealing materials at predetermined locations in the groove and when any one spherical sealing material is not placed, desired watertightness may not be realized. Further, because it is necessary to place the predetermined number of spherical sealing materials in the groove without missing any one material, it is difficult to automatically place the sealing materials using an automated machine and work efficiency of manual assembly performed by a person is low, thus deteriorating the productivity.

Particularly, the LED unit may emit light from a light-emitting device through a lens provided in a cover. Further, when the sealing structure disclosed in each of JP11-340648A, JP10-324360A, and JP2010-251616A is used in an LED unit, the optical characteristics of the LED unit may be largely influenced by a positional error of the cover.

SUMMARY OF THE INVENTION

In view of the above, the present invention provides an LED unit and a lighting fixture using the LED unit, capable of realizing increased watertightness and a high productivity.

In accordance with one aspect of the present invention, there is provided an LED unit including a plate-shaped base; a light-emitting device placed on a surface of the base and having one or more LED chips; and a cover mounted to the base at a location above a front side of the light-emitting device and having a function to transmit light emitted from the light-emitting device, wherein the base has on the surface thereof an annular groove for receiving a seal therein, and the cover has on a surface thereof directed to the base an annular protruding part, the annular protruding part being inserted into the annular groove to seal the base and the cover through the seal, and wherein a distance between the protruding part and the groove in a width direction of the groove is shorter in a section of the groove than the other sections of the groove.

In the LED unit, the groove may have a circular ring shape and a protruding portion protruding inward of the groove, the protruding portion being provided at the section of the groove, so that the distance between the protruding part and the groove in the width direction of the groove is shorter in the section of the groove than the other sections of the groove.

In accordance with another aspect of the present invention, there is provided a lighting fixture, including: the LED unit described above and a housing in which the LED unit is installed.

As described above, the LED unit of the present invention has an increased watertightness and high productivity.

The lighting fixture of the present invention uses the LED unit that has a high level of watertightness and productivity.

BRIEF DESCRIPTION OF THE DRAWINGS

The above and other objects and features of the present invention will become apparent from the following description of preferred embodiments given in conjunction with the accompanying drawings, in which:

FIGS. 3A and 3B are views illustrating a main part of the LED unit, in which FIG. 3A is a plan view and FIG. 3B is an enlarged plan view;

FIGS. 5A and 5B are views illustrating main parts of the LED unit, in which FIG. 5A is a bottom view of a cover and FIG. 5B is a bottom view of a cover pressing member;

FIGS. 16A and 16B are views illustrating another conventional LED lighting fixture, in which FIG. 16A is a sectional view and FIG. 16B is a perspective view.

DETAILED DESCRIPTION OF THE PREFERRED EMBODIMENTS

Figure 1:
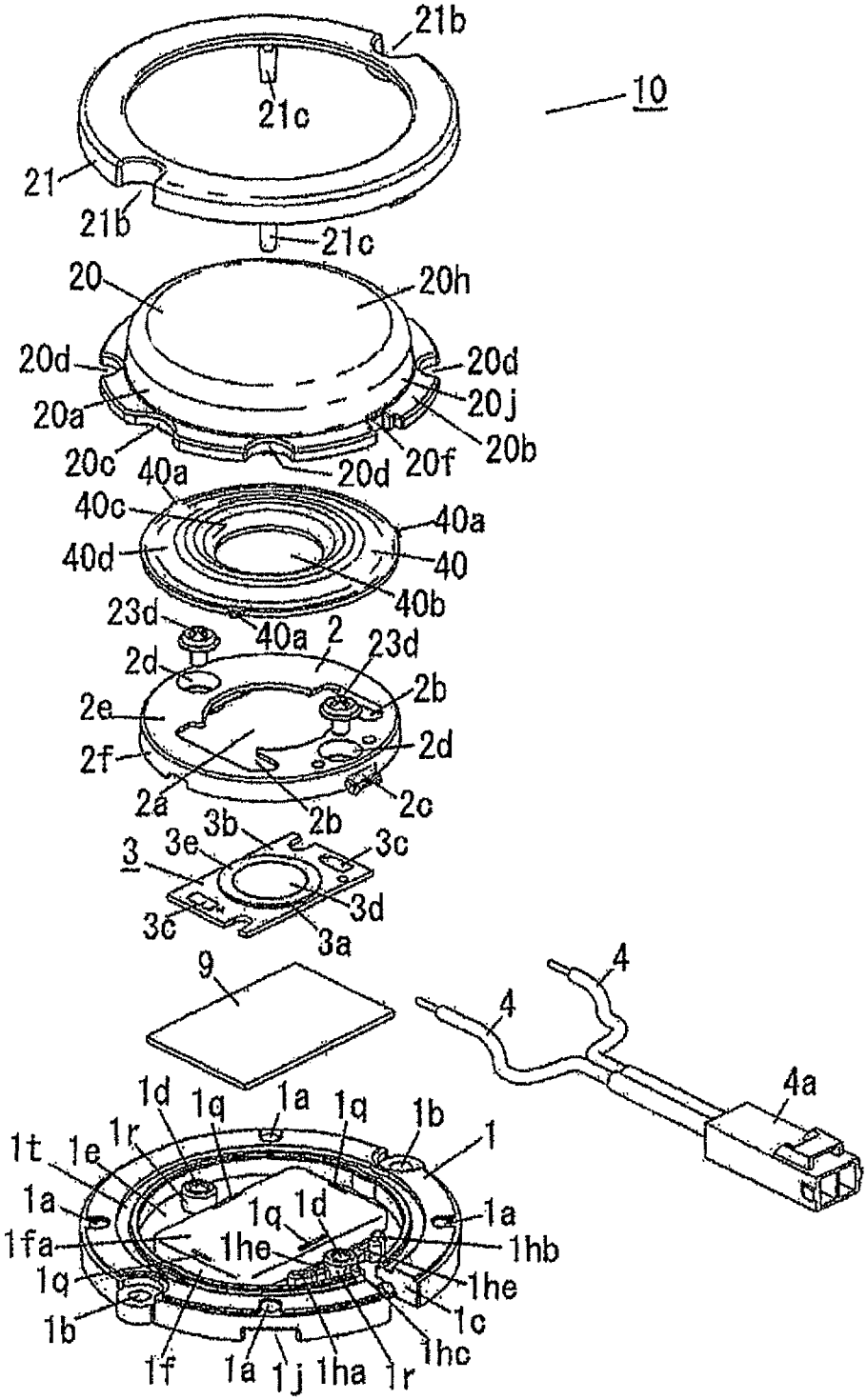
FIG. 1 is an exploded perspective view of an LED unit in accordance with an embodiment of the present invention.

Hereinafter, preferred embodiments of the present invention will be described in detail with reference to the accompanying drawings which form a part hereof.

First Embodiment

Hereinbelow, an LED unit 10 in accordance with a first embodiment of the present invention will be described with reference to FIGS. 1 through 8B.

The LED unit 10 of this embodiment includes a plate-shaped base 1 (for example, a disc-shaped base) having a support block 1*f* on a first surface thereof (an upper surface in FIG. 1), and a heat dissipating sheet 9 that is made of a material having both high electrical insulation property and high heat conductivity is placed on an upper surface 1*fa* of the support block 1*f*. Further, the LED unit 10 is provided with a light-emitting device 3 using one or more LED chips (not shown) placed on a surface of the heat dissipating sheet 9 opposite to the support block 1*f*. The LED unit 10 further includes a holder 2 of tube shape, e.g., a cylindrical shape having bottom wall, for holding the light-emitting device 3 between the holder 2 and the base 1, and a cover 20 that is disposed on a front surface (an upper side in FIG. 1) side of the light-emitting device 3 and is mounted to the first surface of the base 1 and functions to transmit therethrough light emitted from the light-emitting device 3.

Particularly, on the first surface of the base 1 of the LED unit 10, an annular groove 1*t* for receiving a seal 5 therein is formed. An annular protruding part 20*e* extends from the cover 20 in a direction toward the base 1 and is inserted into the groove 1*t* so that the seal 5 can seal both the base 1 and the cover 20 (see FIGS. 3A, 3B and 4). The groove 1*t* further includes inward protrusions 1*tb* that are formed on an outside circumferential surface of the groove 1*t*, for example, at diametrically opposite locations, in which the distance between the protruding part 20*e* and the groove 1*t* in a width direction of the groove 1*t* is shorter in a section of the groove 1*t* having the inward protrusions 1*tb* than the other sections of the groove 1*t*.

Further, the LED unit 10 includes a pair of power-feeding wires (lead wires) 4 that are electrically connected to the light-emitting device 3.

The base 1 used in the LED unit 10 of this embodiment is made of aluminum by a die-casting process, with the support block 1*f* integrally formed on the first surface of the base 1. Here, the base 1 may be made of a material having higher thermal conductivity than that of resin materials, for example, metal, such as copper or stainless steel, without being limited to aluminum. Further, the support block 1*f* may be integrated with the base 1 in a single piece as described above or may be manufactured separately from the base 1.

At the peripheral portion of the base 1, locking screw insert holes 1*b* are formed (in this embodiment, two locations) so as to receive respective locking screws (not shown) in a direction downward from the first surface of the base 1. The locking screws are used to removably mount the LED unit 10 to a housing 11 (see FIG. 9) of a lighting fixture 12 (see FIG. 9).

Here, in the LED unit 10 of this embodiment, the base 1 has a circular shape. However, the shape of the LED unit may have a variety of shapes, for example, a polygonal shape or an elliptical shape, without being limited to the circular shape.

The light-emitting device 3 includes a light-emitting unit 3*a* having LED chips, and a mounting board 3*b* on which the light-emitting unit 3*a* is mounted. Here, the LED chips are connected to each other in series. However, the LED chips may be connected to each other in parallel or in series and parallel.

The light-emitting unit 3*a* includes LED chips (not shown), a peripheral wall 3*e* that surrounds the LED chips and reflects light emitted from the LED chips, and an envelope part 3*d* that covers the LED chips placed inside the peripheral wall 3*e*. Further, in the light-emitting unit 3*a*, the LED chips are blue LED chips that emit blue light and a fluorescent material including a yellow fluorescent material that can be excited by the blue light emitted from the blue LED chips to emit yellow light of broad spectrum is mixed in a light transmissive envelope material (for example, silicone resin, epoxy resin, glass, etc.) of the envelope part 3*d*, so that the light-emitting unit 3*a* serves as a white LED that emits white light. Further, the color of the fluorescent material of the light-emitting unit 3*a* may be, for example, red or green without being limited to the yellow. Further, the light-emitting unit 3*a* may become the white LED by combining UV (ultra violet) and NUV (near ultra violet) LED chips, a red fluorescent material, a green fluorescent material and a blue fluorescent material.

Further, the light-emitting unit 3*a* may become the white LED by combining red LED chips, green LED chips and blue LED chips.

The mounting board 3*b* is made using, for example, a metal base printed wiring board, and a pair of terminals 3*c* is formed on the board 3*b*. The terminals 3*c* are electrically connected to the light-emitting unit 3*a* and are formed by respective conductive patterns. Although the mounting board 3*b* uses the metal based printed wiring board in this embodiment, the mounting board 3*b* may use, for example, a ceramic board or a glass epoxy board without being limited to the metal base printed wiring board. Further, the wires 4 are electrically connected to the respective terminals 3*c* via connection parts (not shown) formed by solder. Here, one wire 4 is connected to one terminal 3*c* (the left-hand terminal 3*c* in FIG. 1) that is connected to the positive pole of the light-emitting unit 3*a*, while the other wire 4 is connected to the other terminal 3*c* (the right-hand terminal 3*c* in FIG. 1) that is connected to the negative pole of the light-emitting unit 3*a*. Further, in order to prevent a connection error of the wires 4, the mounting board 3*b* is marked with polarity symbols "+", "−" at predetermined locations around the respective terminals 3*c*. Further, a reflective layer (not shown) made of a white resist layer is formed on a first surface of the mounting board 3*b* in such a way that the layer covers the mounting board 3*b* except for portions corresponding to the light-emitting unit 3*a* and the terminals 3*c*, and thus light emitted from the light-emitting unit 3*a* can be prevented from being absorbed by the mounting board 3*b*.

Further, the heat-dissipating sheet 9 is placed between a second surface of the mounting board 3*b* and the support block 1*f* protruding from the first surface of the base 1. Accordingly, the light-emitting device 3 can efficiently dissipate heat to the base 1 through the heat-dissipating sheet 9. Further, in the LED unit 10 of this embodiment, the base 1 is made of aluminum that has higher heat conductivity than that of resin, so that heat generated from the light-emitting device 3 can be efficiently dissipated to the housing 11 through the heat-dissipating sheet 9 and the support block 1*f* of the base 1.

The heat-dissipating sheet 9 uses a silicone gel sheet formed of a silicone resin including a gel-phase elastic polymer (elastomer). The gel-phase elastic polymer is in a gel phase and is soft with a low cross-link density and has elasticity. In this embodiment, the heat-dissipating sheet 9 is formed using the silicone gel sheet, however, the heat-dissipating sheet 9 may be formed using another material that has both high electrical insulation property and high heat conductivity and can be easily filled in slits 1*g*. Accordingly, without being limited to the silicone gel, the material of the heat-dissipating sheet 9 may be selected from soft elastic polymer materials (for example, an acrylic resin material) that have high electrical insulation property and high heat conductivity. Further, the heat-dissipating sheet 9 may be formed of adhesive material to be used as an adhesive sheet.

On the first surface of the base 1, a circular depression 1*e* is formed so as to receive some portions of the wires 4 electrically connected to the light-emitting device 3.

At the central portion of the bottom surface of the depression 1*e*, the support block 1*f* is provided to protrude toward the light-emitting device 3 (protruding upward in FIG. 1). When viewed from the top, the support block 1*f* has a square shape (a rectangular shape in this embodiment). Here, the light-emitting device 3 is placed in such a way that the heat dissipating sheet 9 is interposed between the light-emitting device 3 and the upper surface 1*fa* of the support block 1*f*.

Further, the height of the support block 1*f* is determined such that the sum of the height of the support block 1*f* and the thickness of the heat-dissipating sheet 9 is greater than the depth of the depression 1*e*. Accordingly, the support block 1*f* can suppress light reflected by the light-emitting device 3 from being reflected or absorbed by the inner surface of the depression 1*e* of the base 1.

Further, on the upper surface 1*fa* of the support block 1*f*, slits 1*q* for receiving a portion of the soft heat-dissipating sheet 9 are formed at predetermined locations (four locations in FIG. 1). Due to the slits 1*q*, during the process of assembling the LED unit 10, it is possible to prevent the heat-dissipating sheet 9 interposed between the support block 1*f* and the light-emitting device 3 from transversely deviating from a desired location before the light-emitting device 3 and the light-emitting sheet 9 are held between the base 1 and the holder 2.

Specifically, the support block 1*f* is provided with the slits 1*q* on peripheral portions of the upper surface 1*fa* and the heat-dissipating sheet 9 is mounted on the upper surface 1*fa*, so that some portions of the heat-dissipating sheet 9 can be inserted into the slits 1*g*. Here, the portions of the heat-dissipating sheet 9 inserted into the slits 1*q* function as anchors capable of preventing a positional deviation of the heat-dissipating sheet 9 from a desired location. Accordingly, even when vibration is applied to the LED unit 10 during the process of assembling the LED unit 10 as will be described later herein with reference to FIGS. 5A, 5B, 8A and 8B, a positional deviation of the heat-dissipating sheet 9 from the support block 1*f* can be restricted by the portions of the heat-dissipating sheet 9 inserted into the slits 1*q*.

Here, the shape, width and depth of the slits 1*q* formed in the support block 1*f* may be appropriately determined according to the thickness of the heat-dissipating sheet 9 and to the size and shape of the light-emitting device 3. For example, when the thickness of the heat dissipating sheet 9 is 1.0 mm, the width and depth of the slits 1*q* may be set to a range of 0.3 to 0.5 mm. The size of the heat-dissipating sheet 9 is determined such that the sheet 9 can cover the slits 1*q*. Here, the heat-dissipating sheet 9 having the above-mentioned size may be laid on the upper surface 1*fa*. That is, the slits 1*q* are formed in the peripheral portion of the upper surface 1*fa* on which the heat-dissipating sheet 9 is to be placed.

Further, when viewing the support block 1*f* from the top, the slits 1*q* are formed on the upper surface 1*fa* of the rectangular support block 1*f* at peripheral portions corresponding to the four sides of area on which the heat-dissipating sheet 9 is to be placed, so that it is easy to determine whether the heat-dissipating sheet 9 deviates from a desired location or not. When the heat-dissipating sheet 9 deviates from the desired location during the process of assembling the LED unit 10, one or more of the slits 1*q* are exposed outside the heat-dissipating sheet 9 so that it is easy to determine the deviation of the heat-dissipating sheet 9.

The holder 2 includes a pressing plate part 2*e* that holds the light-emitting device 3 between the holder 2 and the support block 1*f*, and a peripheral wall 2*f* that extends from the edge of the pressing plate part 2*e* toward the base 1. The pressing plate part 2*e* of the holder 2 is a circular plate, with a window opening 2*a* formed in the central portion thereof so as to expose the light-emitting unit 3*a* of the light-emitting device 3.

Here, bosses 1*r* are formed to protrude from the bottom surface of the depression 1*e* at locations opposed to each other in a width direction of the support block 1*f*. The bosses 1*r* are provided with respective screw holes 1*d* into which locking screws 23*d* used for mounting the holder 2 to the base 1 are tightened. Accordingly, when compared to a case in which the bosses 1*r* are formed at locations opposed to each other in a lengthwise direction of the support block 1*f*, it is possible to reduce the size of the pressing plate part 2*e* of the holder 2 in the LED unit 10.

Further, in the peripheral portion of the pressing plate part 2*e* of the holder 2, openings 2*b* are formed in such a way that they communicate with the window opening 2*a*. Here, the openings 2*b* can prevent the wires 4 electrically connected to the terminals 3*c* of the light-emitting device 3 from interfering with the holder 2.

Further, screw insert holes 2*d* are formed at the peripheral portion of the pressing plate part 2*e* of the holder 2 correspondingly to the respective screw holes 1*d* of the base 1, so that the locking screws 23*d* can be inserted into the respective screw insert holes 2*d* from a front surface side (the upper surface side in FIG. 1) of the pressing plate part 2*e* of the holder 2. Here, when the holder 2 is mounted to the base 1, the light-emitting unit 3*a* of the light-emitting device 3 is exposed through the window opening 2*a* of the holder 2 and the light-emitting device 3 is held between the base 1 and the holder 2. Further, the locking screws 23*d* are inserted into the respective screw insert holes 2*d* in a downward direction from the upper surface side of the pressing plate part 2*e* of the holder 2 to be tightened to the respective screw holes 1*d* of the base 1, thereby mounting the holder 2 to the base 1. Here, the heat-dissipating sheet 9 is interposed between the light-emitting device 3 and the base 1.

Accordingly, when the locking screws 23*d* are tightened to the respective screw holes 1*d* in the LED unit 10 of this embodiment, stress that may be applied to the light-emitting device 3 is lowered because the stress can be absorbed by the heat-dissipating sheet 9, so that it is possible to prevent undesired stress from being applied to the light-emitting device 3.

In the LED unit 10 of this embodiment, the pressing plate part 2*e* of the holder 2 has a circular shape, however, the shape is not limited thereto and may be changed into other shapes, for example, a polygonal shape or an elliptical shape.

Further, in the peripheral portion of the base 1, a wire lead mouth 1*c* is provided to guide the wires 4 that are electrically connected to the light-emitting device 3 to the outside of the LED unit 10.

The wire lead mouth 1*c* is a notch that is formed in the peripheral portion of the base 1 and allows a user to change the direction in which the wires 4 are guided to the outside of the LED unit 10.

Specifically, the wire lead mouth 1*c* is formed by opening a second surface of the base 1 (the lower surface in FIG. 2), the side surface and the first surface of the base 1 in the peripheral portion of the base 1. That is, due to the wire lead mouth 1*c*, the direction in which the pair of wires 4 is guided to the outside of the LED unit 10 can be changed between a direction toward the second surface of the base 1 and a sideward direction of the base 1 (see the circular arc-shaped arrow in FIG. 2). Further, the wire lead mouth 1*c* is configured such that when the pair of wires 4 is led through the wire lead mouth 1*c* to a direction perpendicular to the second surface of the base 1, the wires 4 can be placed inside the outer periphery of the base 1.

Figure 16A:
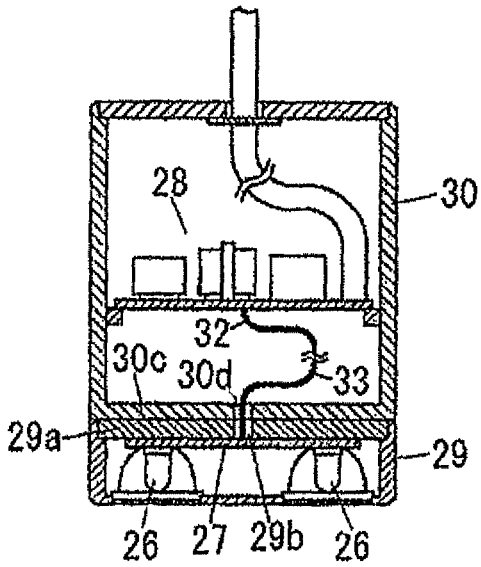
FIG. 16A (PRIOR ART)
Figure 16B:
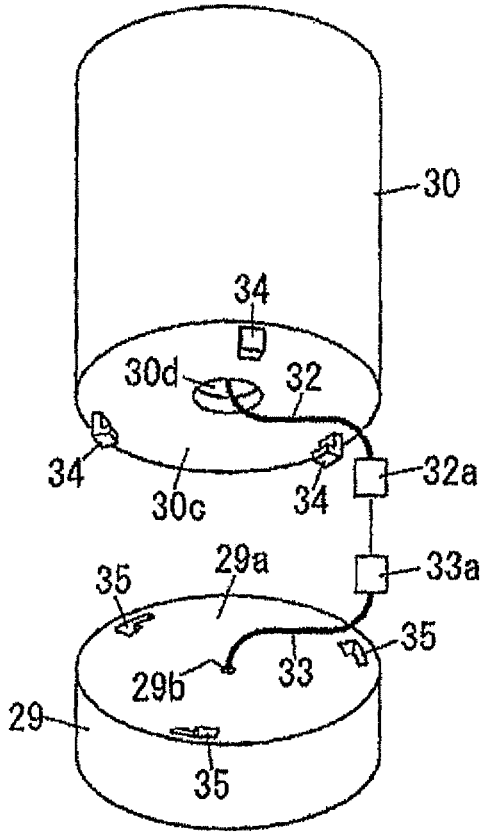
FIG. 16B (PRIOR ART)

Accordingly, in the LED unit 10 of this embodiment, it is possible to guide the wires 4 to the direction toward the second surface of the base 1 and the side direction of the base 1 through the wire lead mouth 1*c*. That is, compared to the conventional LED unit shown in FIGS. 16A and 16B, in the LED unit 10 of this embodiment, it is possible to increase the degree of freedom of relative positional relationship between the LED unit 10 and a power unit 15 (see FIG. 9) that supplies electricity to the LED unit 10. Because the degree of freedom of relative positional relationship between the LED unit 10 and the power unit 15 can be increased, the LED unit 10 may be easily mounted to various housings 11 having different shapes. Further, as described above, the wire lead mouth 1*c* is configured in such a way that when the wires 4 are guided through the wire lead mouth 1*c* to the direction perpendicular to the second surface of the base 1, the wires 4 can be placed inside the outer circumference of the base 1. Accordingly, when the housing 11 is a cylindrical housing as an example, it is possible to set the minimum diameter of the housing 11 to about the size of the base 1, thereby to make the lighting fixture 12 compact.

Figure 2:
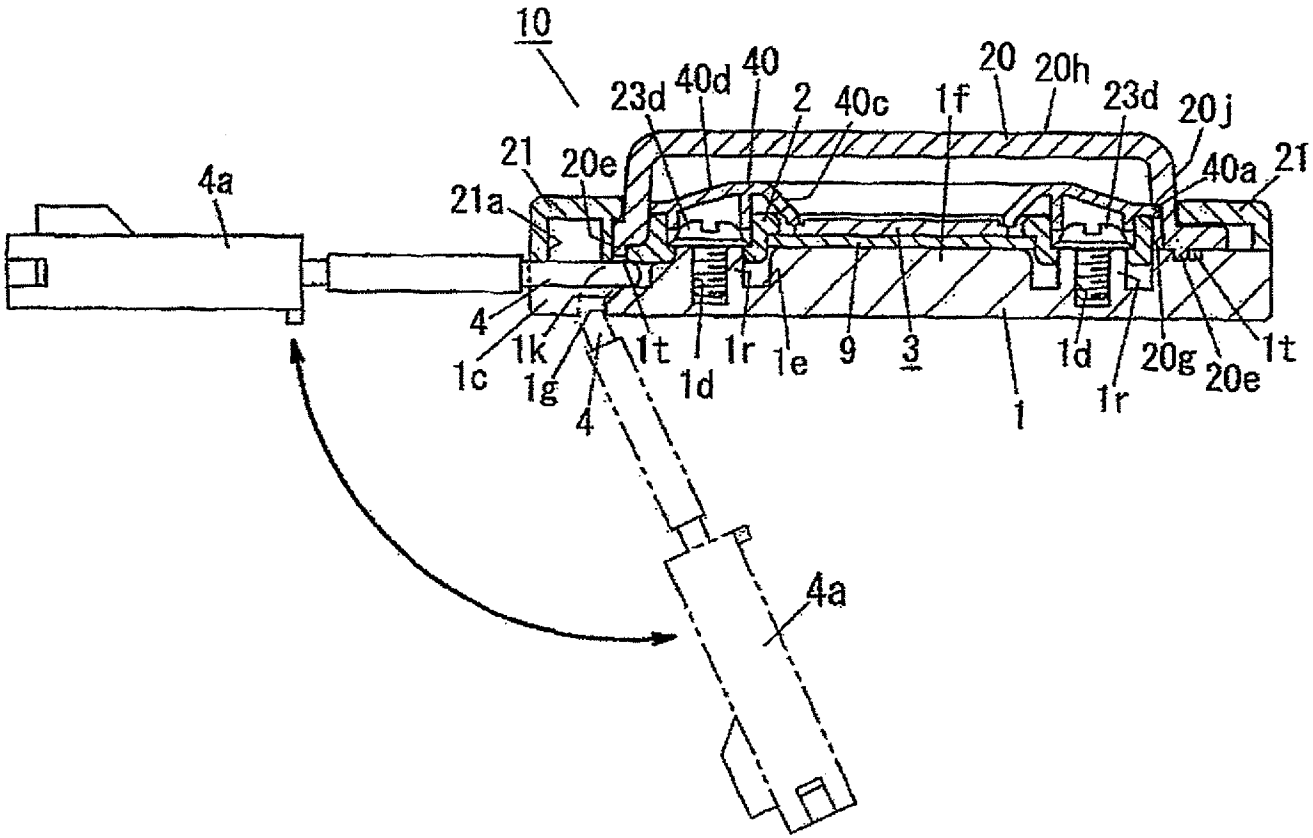
FIG. 2 is a sectional view of the LED unit.

However, in the depression 1*e* of the base 1, ribs 1*ha* and 1*hb* protrude from the inner bottom surface of the depression 1*e* at locations around the wire lead mouth 1*c* (the ribs protrude downwards in FIG. 2). The ribs 1*ha* and 1*hb* hold the respective wires 4 against the inner circumferential surface of the depression 1*e* (see FIG. 6A). Specifically, on the inner bottom surface of the depression 1*e* of the base 1 at locations around the wire lead mouth 1*c*, the first rib 1*ha* protrudes so as to hold the first wire 4 against the inner circumferential surface of the depression 1*e*, and the second rib 1*hb* protrudes so as to hold the second wire 4 against the inner circumferential surface of the depression 1*e*. Further, on the inner bottom surface of the depression 1*e* of the base 1, a rib 1*hc* protrudes at a predetermined location between two ribs 1*hd* that protrude from the inner circumferential surface of the depression 1*e* at borders with the inside surfaces 1*g* of the wire lead mouth 1*c*, so that the rib 1*hc* holds the wires 4 (see FIG. 7A). Here, the rib 1*hc* is integrated with the boss 1*r*. Further, the ribs 1*ha* and 1*hb* are connected to each other by a connecting arm the that protrudes from the inner bottom surface of the depression 1*e* of the base 1.

Accordingly, in the LED unit 10 of this embodiment, the wires 4 electrically connected to the light-emitting device 3 can be stably held in the base 1 without being tensioned with no additional elements. That is, the LED unit 10 of this embodiment does not need any additional element for reducing the tension applied to the wires 4 so that the LED unit 10 can easily reduce the tension of the wires 4 at low cost. Further, because this LED unit 10 can reduce the tension applied to the wires 4 as described above, it is possible to prevent any disconnection that may be caused by stress applied to the connection parts (not shown) between the wires 4 and the terminals 3*c* of the light-emitting device 3.

Further, on a side surface of the holder 2 of the LED unit 10, a holding part 2*c* is formed at a location corresponding to the wire lead mouth 1*c* of the base 1 so as to hold the wires 4 guided through the wire lead mouth 1*c* in cooperation with the base 1. That is, in the LED unit 10 of this embodiment, the wires 4 electrically connected to the light-emitting device 3 can be held in the base 1 and between the base 1 and the holding part 2*c*.

Further, as shown in FIG. 2, the base 1 is provided with a chamfer 1*k* between the inside surface 1*g* of the wire lead mouth 1*c* formed in the base 1 and the inner bottom surface of the depression 1*e* of the base 1. Because the chamfer 1*k* is formed in the base 1 of the LED unit 10, it is possible to reduce the stress that may be applied to the wires 4 when the wires 4 are biased toward the second surface of the base 1. Further, when the wires 4 are biased toward the second surface of the base 1 in the LED unit 10, the stress that may be applied to the wires 4 can be reduced as described above, so that it is possible to prevent the wires 4 from being disconnected by the stress. Further, in this embodiment, the chamfer 1*k* is configured as a C-chamfer, however, it should be understood that the chamfer may be configured as, for example, an R-chamfer without being limited to the C-shaped chamfer.

Further, the wire lead mouth 1*c* may be formed by opening the side surface and the first surface (the upper surface in FIG. 2) in the peripheral portion of the base 1 in addition to the second surface (the lower surface in FIG. 2) of the peripheral portion of the base 1. Further, in the peripheral portion of the cover pressing member 21, it is preferred that an open portion corresponding to the wire lead mouth 1*c* be formed by opening a second surface, the side surface and a first surface of the cover pressing member 21 even though it is not shown in the drawings. Accordingly, the wire lead mouth 1*c* allows the direction in which the wires 4 are led to the outside of the LED unit 10 to be changed between the direction toward the second surface of the base 1 and the direction toward the first surface of the base 1. Therefore, the degree of freedom of relative positional relationship between the LED unit 10 and the power unit 15 can be increased, and the LED unit 10 can be easily mounted to various housings 11 having different shapes.

The cover 20 is made of a light-transmissive material (for example, a silicone resin, an acrylic resin, glass, etc.). Further, the cover 20 includes a cylindrical cover body 20*a* that is placed inside the periphery of the base 1 and has a bottom capable of covering the light-emitting device 3, and a rim 20*b* that extends outward from the edge of the cover body 20*a* and is used to mount the cover 20 to the base 1. The cover body 20*a* includes a circular light-transmitting part 20*h* that is disposed at a distant from the base 1 and transmits light emitted from the light-emitting device 3, and a cylindrical part 20*j* that extends from the light-transmitting part 20*h* toward the base 1. Here, a lens may be provided in the light-transmitting part 20*h*. Further, the shape of the cover body 20*a* may be configured to have, for example, a dome-shape without being limited to the cylindrical shape.

Further, a decorative cover 40 is placed between a surface (a lower surface in FIG. 1) of the cover 20 directed toward the base 1 and the upper surface of the pressing plate part 2*e* of the holder 2. The decorative cover 40 has a ring shape (for example, a circular ring shape) and covers the locking screws 23*d* passing through the respective screw insert holes 2*d* of the holder 2 and the wires 4 and 4 exposed through the openings 2*b* of the holder 2.

The decorative cover 40 is made of a light-shielding material (for example, a white opaque resin, etc.) and is placed inside the cover body 20*a* of the cover 20. The decorative cover 40 has at a central portion thereof a window opening 40*b* for exposing the light-emitting unit 3*a* of the light-emitting device 3. An inner peripheral surface 40*c* of the window opening 40*b* is appropriately inclined to reflect the light emitted from the light-emitting unit 3*a* to obtain a desired light distribution.

Accordingly, because the decorative cover 40 that has the inner peripheral surface 40*c* of the window opening 40*b* and an outer peripheral surface 40*d* extending outward from the inner peripheral surface 40*c* is placed on the upper surface of the pressing plate part 2*e* of the holder 2 in the LED unit 10 of this embodiment, it is possible to prevent the locking screws 23*d* and the wires 4 from being viewed from the outside through the cover 20 and, thus, a good appearance of the LED unit 10 can be realized.

Further, in the peripheral portion of the rim 20*b* of the cover 20, an annular protruding part 20*e* (see FIG. 2) protrudes toward the base 1. Here, the groove 1*t* is formed in the first surface of the base 1 at a location corresponding to the protruding part 20*e* of the cover 20 so as to receive the protruding part 20*e* therein. A sealing material (for example, a silicone resin) is filled in the groove 1*t* so as to form a seal 5. Accordingly, in the LED unit 10 of this embodiment, the protruding part 20*e* of the cover 20 is inserted into the groove 1*t* of the base 1 so that the base 1 and the cover 20 are sealed through the seal 5, thereby preventing the moisture or impurities from being introduced into the LED unit 10.

Figure 3A:
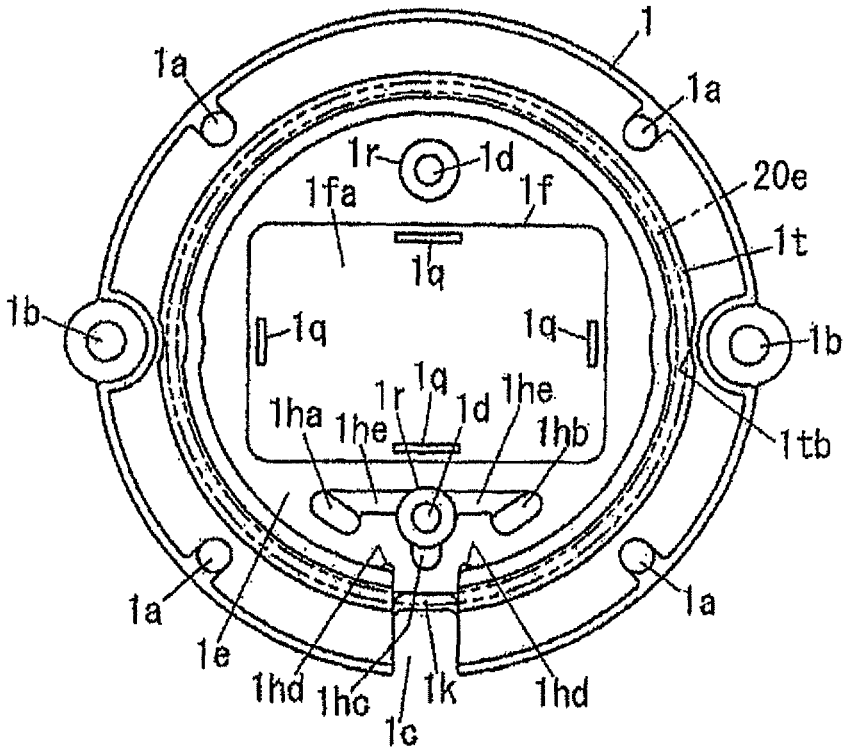

Specifically, in the LED unit 10 of this embodiment, the acrylic cover 20 that has a function as a lens transmitting the light emitted from the light-emitting device 3 is mounted to the base 1 by using the cover pressing member 21. Here, the protruding part 20*e* of the cover 20 is inserted into the groove 1*t*. Further, the base 1 used in the LED unit 10 of this embodiment has the annular groove 1*t* that is formed on the first surface of the base 1 as shown in FIGS. 3A and 35 and receives the seal 5 therein. Here, the groove 1*t* is configured in such a way that inward protrusions 1*tb* are protruded radially inwardly from the outer circumferential surface of the groove 1*t* and, thus, the distance between the protruding part 20*e* (see the two-dot chain line in FIGS. 3A and 3B) and the groove 1*t* in the width direction of the groove 1*t* is shorter in the section of the groove 1*t* having the inward protrusions 1*tb* than the other section of the groove it. In this embodiment, the inward protrusions 1*tb* are the arc-shaped protrusions that are protruded radially inwardly from the outer circumferential surface of the groove 1*t*, however, the shape of the inward protrusions 1*tb* may have a variety of shapes without being limited to the arc shape if the inward protrusions 1*tb* are protruded radially inwardly from the outer circumferential surface of the groove 1*t*.

Further, the inward protrusions 1*tb* are disposed at two locations of the outer circumferential surface of the groove 1*t* in this embodiment, they may be disposed at an inner circumferential surface of the groove 1*t*, and the number of protrusions is not limited to two.

Figure 3B:
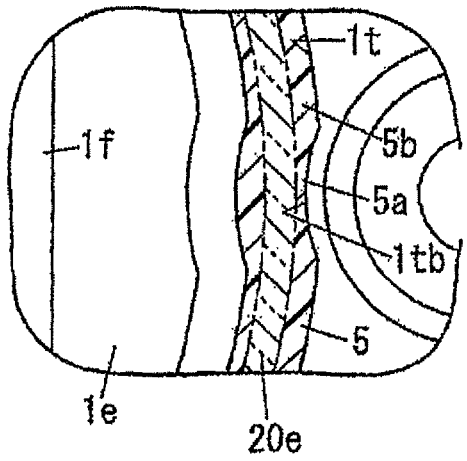
Figure 4:
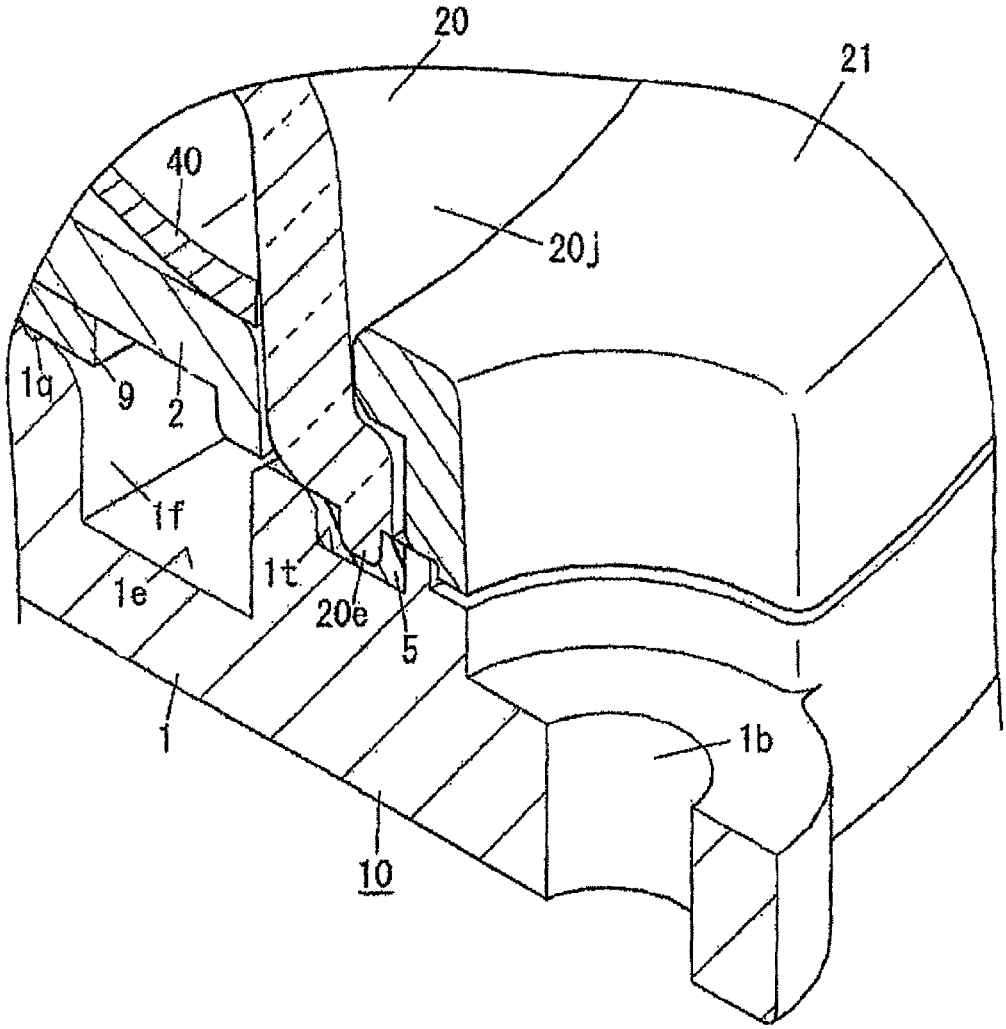
FIG. 4 is a view illustrating the LED unit.

In other words, the inward protrusions 1*tb* of the groove 1*t* form a specified structure in which the distance between the protruding part 20*e* and the groove 1*t* in the width direction of the groove 1*t* is shorter in the section of the groove 1*t* having the inward protrusions 1*tb* than the other section of the groove 1*t*, which makes the seal 5 have thinner parts 5*a* (see FIG. 3B). Here, the hardening time of the sealing material that forms the seal 5 depends upon the amount of the sealing material. Therefore, the hardening time of the sealing material is shorter in the thinner parts 5*a* compared to thicker parts 5*b*, and the hardening of the material of the seal 5 is started at the thinner parts 5*a* of the seal 5, so that the thinner parts 5*a* can be more quickly hardened than the thicker parts 5*b*. Accordingly, it is possible to prevent the cover 20 from undesirably deviating from a desired location by vibration applied thereto during the process of hardening the material of the seal 5.

Further, even when a torque is applied to the cover 20 after the sealing material has been hardened, the inward protrusions 1*tb* that inwardly protrude from the outer circumferential surface of the groove 1*t* function to stop a rotation of the thicker parts 5*b* of the seal 5, thereby restricting a rotation of the cover 20. When compared to an LED unit in which the seal 5 is inserted into a groove having a simple annular shape without the protrusions, the LED unit 10 of this embodiment can increase the adherence of the seal 5 relative to the cover 20 and the base 1 against a torque applied to the cover 20.

That is, during the process of assembling the LED unit 10 of this embodiment, the seal 5 is inserted into the groove 1*t* and, thereafter, the protruding part 20*e* of the cover 20 is inserted into the groove 1*t*, so that the base 1 and the cover 20 are sealed through the seal 5, thereby preventing moisture or impurities being introduced into the LED unit 10. Further, the LED unit 10 is configured in such a way that the distance between the protruding part 20*e* and the groove 1*t* in the width direction of the groove 1*t* is shorter in a section of the groove 1*t* than the other sections, thereby reducing the hardening time of the sealing material and increasing the adherence of the hardened sealing material relative to the cover 20 and the base 1 against a torque applied to the cover 20.

The material of the seal 5 of this embodiment uses a silicone resin. However, the seal 5 may use another resin material (for example, epoxy resin, urethane resin, etc.).

The cover pressing member 21 is made of a light-shielding material (for example, metal, such as aluminum, a white opaque resin, etc.) and is configured as a flat ring-shaped structure (a circular ring-shaped structure in the embodiment) such that the cover pressing member 21 does not disturb the light which is emitted from the light-emitting device 3 and transmitted through the cover body 20*a* of the cover 20. Here, the rim 20*b* of the cover 20 is held between the cover pressing member 21 and the base 1.

Figure 5A:
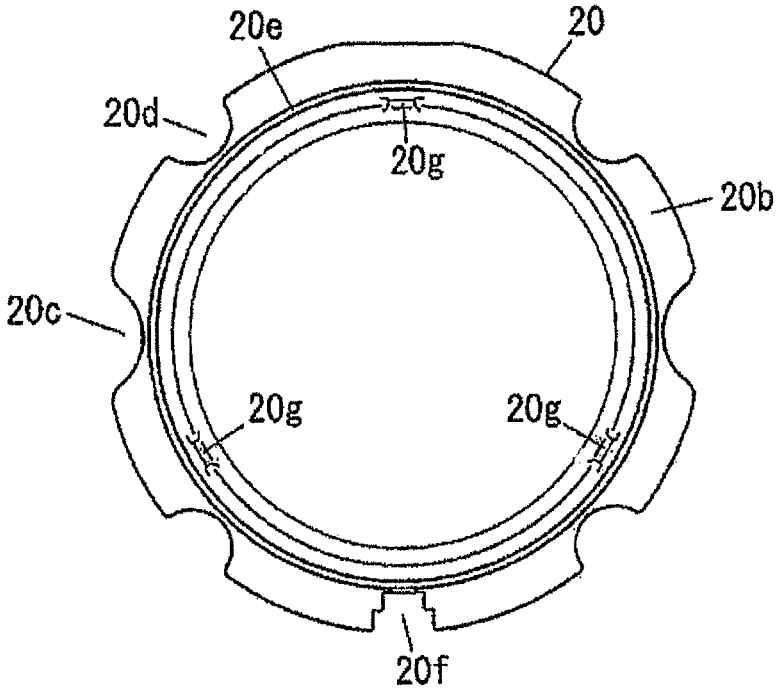
Figure 5B:
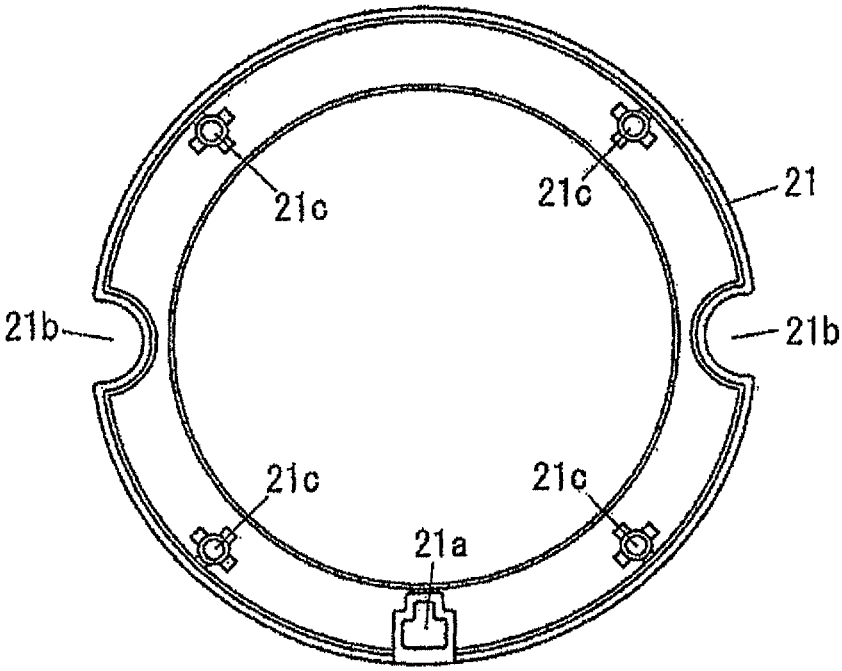

Further, on a surface of the cover pressing member 21 that is directed toward the base 1, a channel 21*a* is formed in the peripheral portion of the cover pressing member 21 at a location corresponding to the wire lead mouth 1*c* of the base 1, as shown in FIG. 5B, so that when the sealing material of the seal 5 filled in the groove 1*t* of the base 1 overflows during a process of assembling the LED unit 10, the channel 21*a* can collect the overflowing sealing material. Here, in the outer circumferential portion of the rim 20*b* of the cover 20, a guide notch 20*f* is formed at a location corresponding to the channel 21*a* of the cover pressing member 21, as shown in FIG. 5A. The guide notch 20*f* guides the overflowing material of the seal 5 to the channel 21*a* of the cover pressing member 21.

Further, cylindrical bosses 21*c* (four bosses in this embodiment) are formed on the first surface (a lower surface in FIG. 1) of the cover pressing member 21 in such a way that the bosses 21*c* protrude toward the base 1 (see FIG. 5B). Here, semicircular cutouts 20*d* are formed in the outer edge of the rim 20*b* of the cover 20 at locations corresponding to the bosses 21*c* of the cover pressing member 21 so that the bosses 21*c* can pass therethrough. Further, in the peripheral portion of the base 1, through holes 1*a* are formed at locations corresponding to the respective bosses 21*c* of the cover pressing member 21 so as to receive the bosses 21*c* therein. Here, when the cover 20 is mounted to the base 1, the bosses 21*c* of the cover pressing member 21 are inserted into the respective through holes 1*a* of the base 1 and, thereafter, the leading ends of the bosses 21*c* are irradiated by, for example, laser beams from the side of the second surface (the lower surface in FIG. 1) of the base 1, thereby being plastically deformed so that the diameters of the ends become greater than those of the through holes 1*a* of the base 1 and, accordingly, the cover 20 can be attached to the base 1. In other words, the shape of the bosses 21*c* is changed to a mushroom shape. Here, on the second surface of the base 1, depressions 1*j* are formed at locations corresponding to the respective through holes 1*a* in such a way that the depressions 1*j* communicate with the respective through holes 1*a* and receive the heads of the mushroom-shaped bosses 21*c*. The depth of the depressions 1*j* is determined in such a way that the heads of the mushroom-shaped bosses 21*c* do not protrude from a plane including the second surface of the base 1.

In the LED unit 10 of this embodiment, the rim 20*b* of the cover 20 is held between the base 1 and the cover pressing member 21 so that it is possible to prevent excessive stress from being applied to the cover 20. Further, in the LED unit 10, the cover pressing member 21 is mounted to the base 1 without using locking screws so that the LED unit 10 can be free from a problem caused by the screws that may be loosened. Further, in the LED unit 10, the cover pressing member 21 has a flat ring shape so that when the LED unit 10 mounted to the housing 11 is turned on, the desired distribution and uniformity of light transmitted through the cover body 20*a* of the cover 20 are not reduced. Further, the method of mounting the cover 20 to the base 1 may be accomplished by using, for example, locking screws without being limited to the above.

Further, on the edge of the cover pressing member 21, semicircular cutouts 21*b* are formed at locations corresponding to the respective locking screw insert holes 1*b* of the base 1 so as to allow locking screws (not shown) to pass through the cover pressing member 21 from the side of the second surface (the upper surface in FIG. 1) of the cover pressing member 21. Further, on the edge of the rim 20*b* of the cover 20, semicircular cutouts 20*c* are formed at locations corresponding both to the respective locking screw insert holes 1*b* of the base 1 and to the respective cutouts 21*b* of the cover pressing member 21 so as to allow the locking screws to pass through the cover 20 from the side of the cover pressing member 21. Accordingly, because the cutouts 21*b* are formed on the edge of the cover pressing member 21 and the cutouts 20*c* are formed on the edge of the rim 20*b* of the cover 20 in the LED unit 10 of this embodiment, it is possible to removably mount the base 1 of the LED unit 10 to the housing 11 of the lighting fixture 12 from the side of the cover 20.

Figure 9:
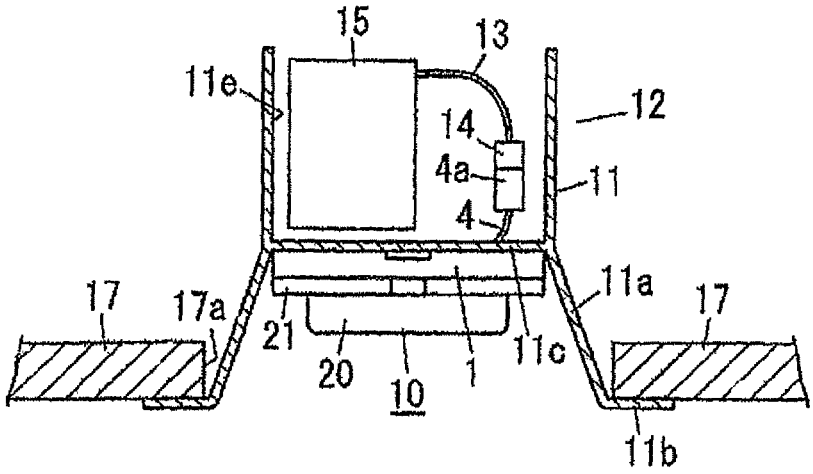
FIG. 9 is a sectional view of an LED lighting fixture having the LED unit.

Further, the wires 4 are provided with a connector 4*a* at the ends thereof led through the wire lead mouth 1*c* of the base 1. This connector 4*a* may be detachably connected to a connector 14 that is provided at the end of a wire 13 electrically connected to the power unit 15, as shown in FIG. 9.

Accordingly, in the LED unit 10 of this embodiment, because the connector 4*a* is provided at the ends of the wires 4 so as to be detachably connected to the connector 14 of the power unit 15, which makes connecting/disconnection from the LED unit 10 easy. Further, in the LED unit 10, the connector 4*a* is provided at the ends of the wires 4 and the base 1 can be removably mounted to the housing 11 of the lighting fixture 12 from the side of the cover 20, so that a user can easily replace the LED unit 10 with a new one.

Hereinbelow, the process of assembling the LED unit 10 will be described with reference to FIGS. 6A to 8B.

Figure 6A:
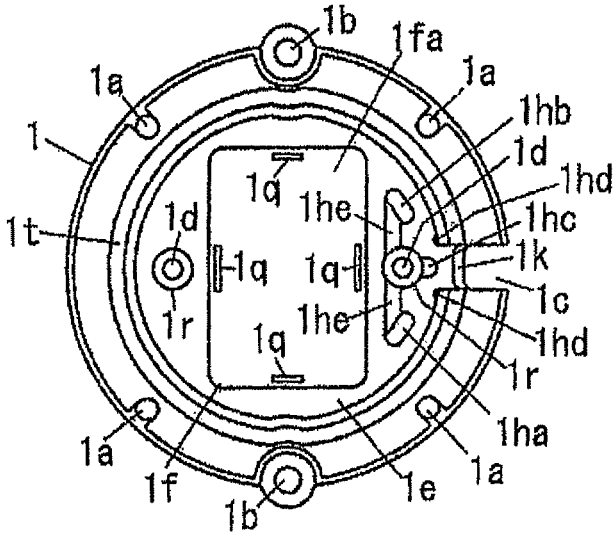
FIGS. 6A through 6C are views illustrating a process of assembling the LED unit.
Figure 6B:
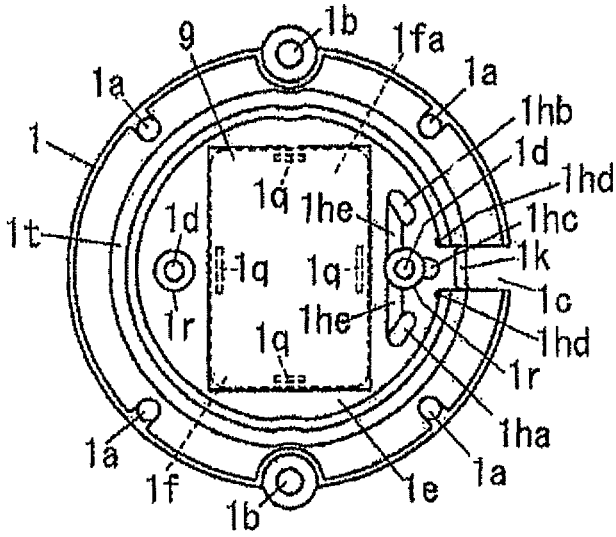

First, on the upper surface 1*fa* of the rectangular support block 1*f* provided on the first surface of the base 1 shown in FIG. 6A, the rectangular heat-dissipating sheet 9 having a size larger than that of the upper surface 1*fa* is laid (see FIG. 68). Here, by laying the heat-dissipating sheet 9 on the upper surface 1*fa* of the support block 1*f*, a portion of the heat-dissipating sheet 9 is inserted into the slits 1*q* of the upper surface 1*fa*.

Figure 6C:
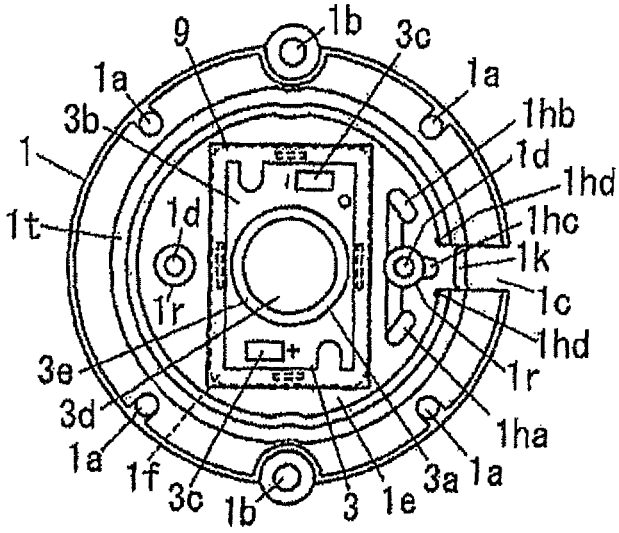

Thereafter, the light-emitting device 3 is placed on the heat dissipating sheet 9 (see FIG. 6C).

Figure 7A:
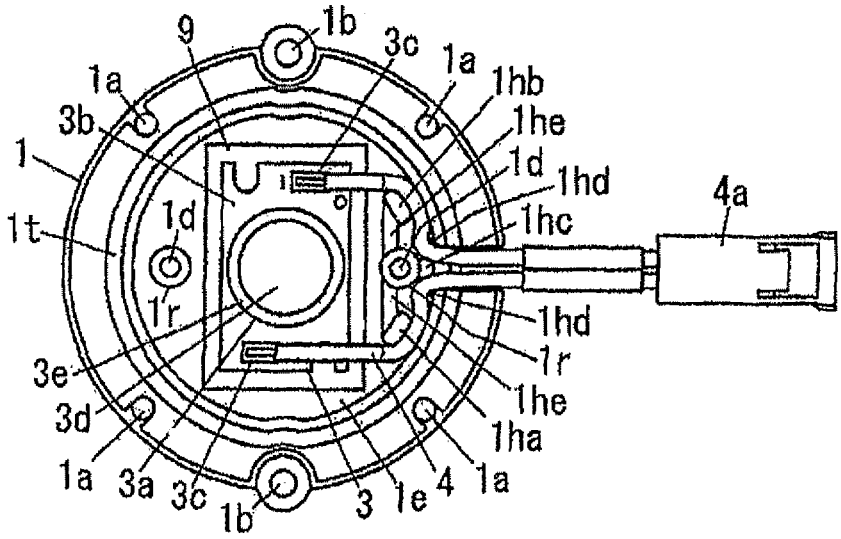
FIGS. 7A through 7C are views illustrating the process of assembling the LED unit.

Consequently, the wires 4 are held by the inner circumferential surface of the depression 1*e* of the base 1 and the ribs 1*ha* and 1*hb*, and the wires flare electrically connected to the terminals 3*c* of the mounting board 3*b* (see FIG. 7A).

Figure 7B:
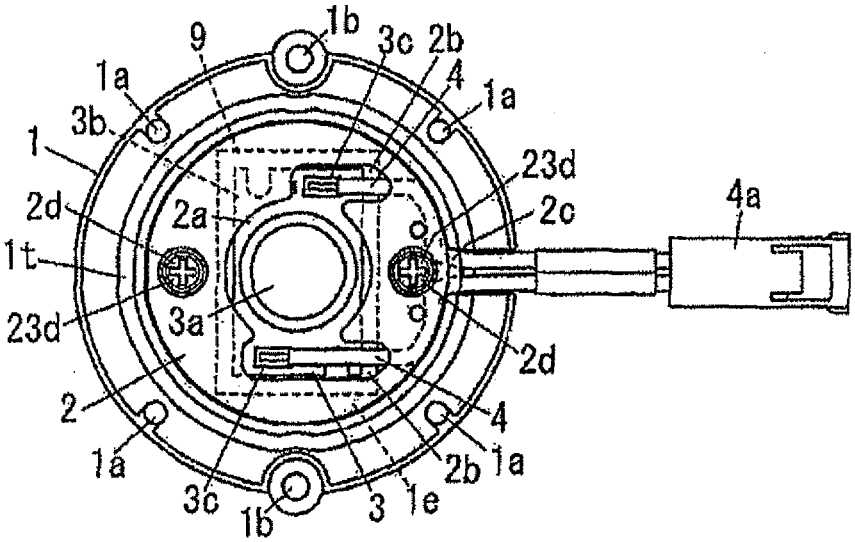

Thereafter, the light-emitting device 3 is covered with the holder 2 and the holder 2 is fixed to the base 1 by using the locking screws 23*d* (see FIG. 7B).

On the holder 2, the decorative cover 40 is placed to surround the light-emitting unit 3*a* of the light-emitting device 3 (see FIG. 70).

Thereafter, the material of the seal 5 is applied to the groove 1*t* of the base 1 (see FIG. 7C), and the protruding part 20*e* of the cover 20 is inserted into the groove 1*t* in a state that lugs 40*a* protruding from the peripheral portion of the decorative cover 40 are aligned with respective recessed parts 20*g* formed in the inner circumferential surface of the cover 20. Accordingly, the cover 20 is placed on the base 1 (see FIG. 8A).

Figure 7C:
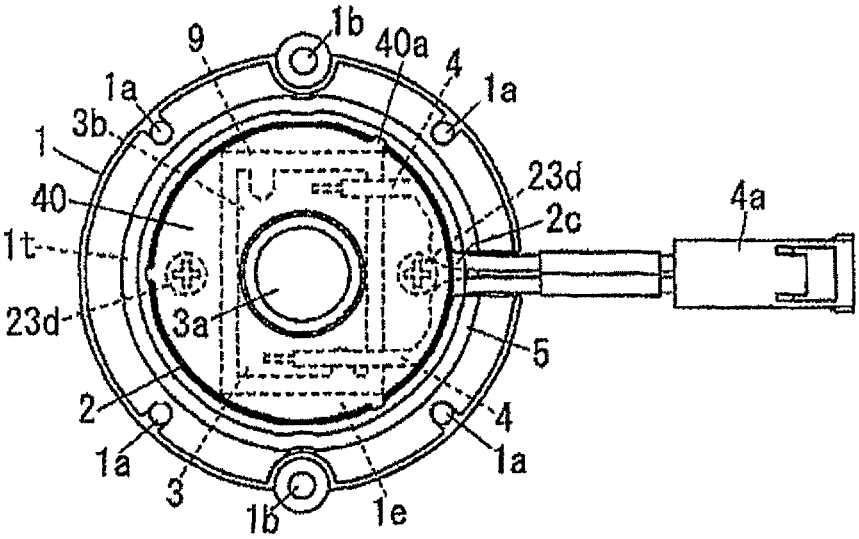

Here, unlike the embodiment in which the cover 20 is placed on the base 1 after the decorative cover 40 has been placed on the base 1 to surround the light-emitting unit 3*a* of the light-emitting device 3 as shown in FIG. 7C, the cover 20 may be placed on the base 1 after the decorative cover 40 has been temporarily maintained in the cover 20 by inserting the lugs 40*a* of the decorative cover 40 into the respective recessed parts 20*g* of the cover 20.

Figure 8A:
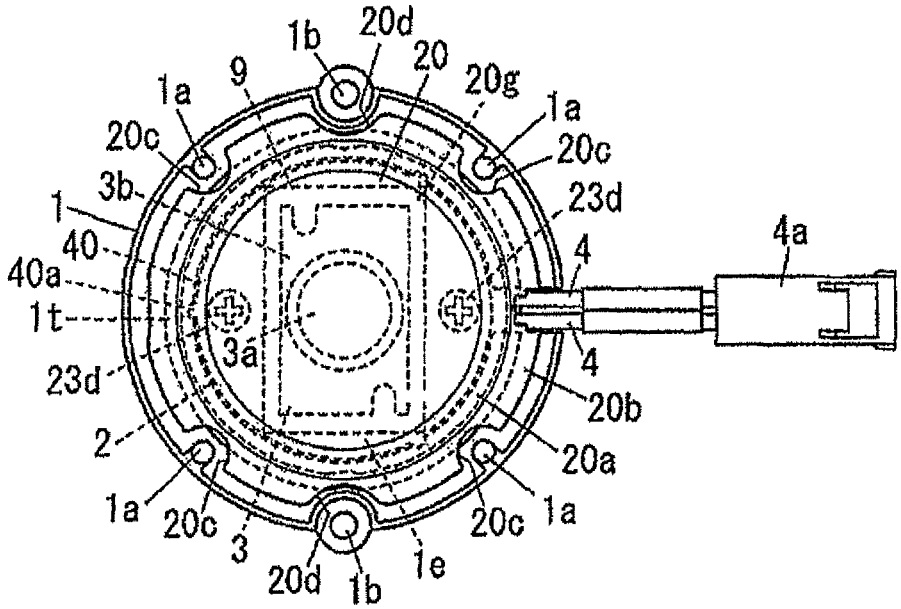
FIGS. 8A and 8B are views illustrating the process of assembling the LED unit.
Figure 8B:
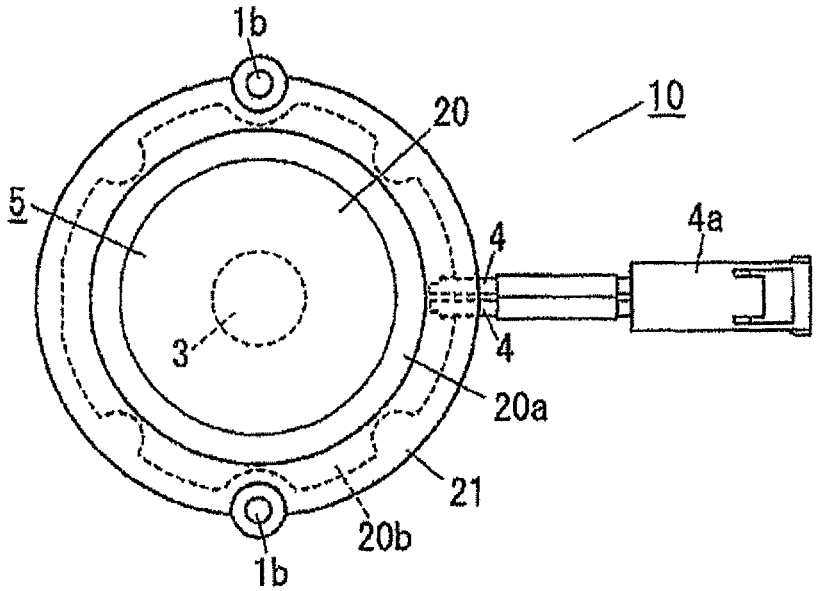

Finally, the bosses 21*c* of the cover pressing member 21 are inserted into the respective through holes 1*a* of the base 1 and, thereafter, the leading ends of the bosses 21*c* are irradiated by, for example, laser beams from the side of the second surface of the base 1 to be plastically deformed, thereby finishing the assembly of the LED unit 10 (see FIG. 8B).

A lighting fixture 12 having the LED unit 10 that has been assembled by the above-mentioned process will be described with reference to FIGS. 9 to 14.

The lighting fixture 12 includes an LED unit 10 and a metal housing 11 to which the LED unit 10 can be removably mounted. In the lighting fixture 12, the housing 11 is a metal housing so that unlike a resin housing, heat generated from the light-emitting device 3 of the LED unit 10 can be efficiently dissipated to the surroundings via the heat-dissipating sheet 9, the base 1 and the housing 11. Further, in the embodiment, the material of the housing 11 is aluminum, however, the material of housing 11 may use another metal without being limited to aluminum. Further, the material of the housing 11 may be other material than metal.

The housing 11 is configured so that the LED unit 10 can be easily removably mounted to the housing 11. Specifically, the housing 11 is provided with screw holes (not shown) at locations corresponding to the respective locking screw insert holes 1*b* of the base 1 so that locking screws can be tightened to the screw holes.

The lighting fixture 12 having the construction shown in FIG. 9 is, for example, a downlight that is embedded in a ceiling member 17. The housing 11 of this lighting fixture 12 includes a cylindrical housing body 11*a* that has a bottom for holding an LED unit 10, and a flange part 11*b* that extends outward from the outer edge of the housing body 11*a*. Further, the housing 11 is installed in an embedding hole 17*a* that is formed in the ceiling member 17, so that the flange part 11*b* of the housing 11 can come into contact with the peripheral portion of the embedding hole 17*a* on the surface of the ceiling member 17 and can be mounted to the ceiling member 17.

A chamber 11*e* is provided on the bottom 11*c* of the housing 11 so as to hold the power unit 15 therein. Here, the power unit 15 installed in the housing 11 is spaced apart from the housing 11 so that the lighting fixture 12 of this embodiment can prevent heat of the power unit 15 from being transferred to the LED unit 10 via the housing 11.

Further, a lead hole (not shown) is formed through the bottom 11*c* of the housing 11 so as to lead the wires 4 and the connector 4*a* led from the LED unit 10 into the chamber 11*e*.

Figure 10:
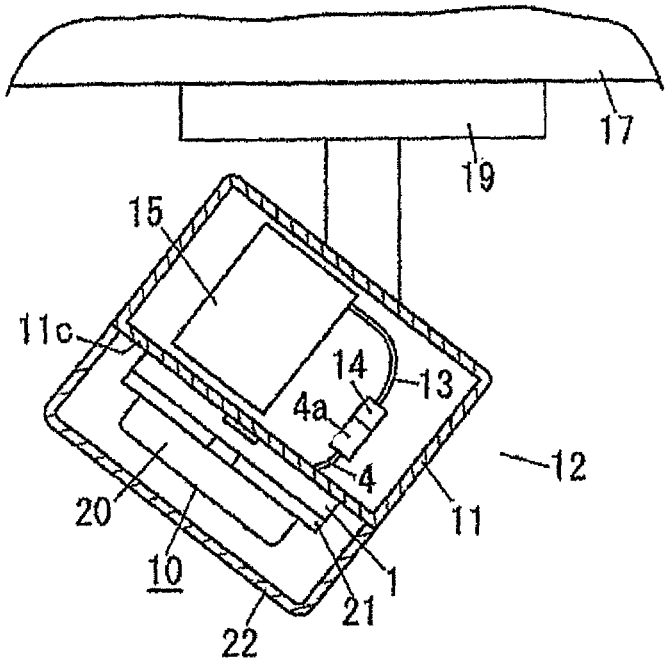
FIG. 10 is a sectional view of another LED lighting fixture having the LED unit.

Further, the lighting fixture 12 having the construction shown in FIG. 10 is, for example, a spotlight of which the housing 11 is held by a housing holder 19 that is mounted to the ceiling member 17. The housing 11 of this lighting fixture 12 is a box-shaped housing. Here, the power unit 15 installed inside housing 11 is spaced apart from the housing 11.

In this lighting fixture 12, a lead hole (not shown) is formed through the bottom 11*c* of the housing 11 so as to lead the wires 4 and the connector 4*a* led from the LED unit 10 into the housing 11. Further, on the bottom 11*c* of the housing 11, a diffusing plate 22 is mounted to cover the LED unit 10, the diffusing plate 22 serving to diffuse and transmit light emitted from the cover 20 of the LED unit 10.

Figure 11:
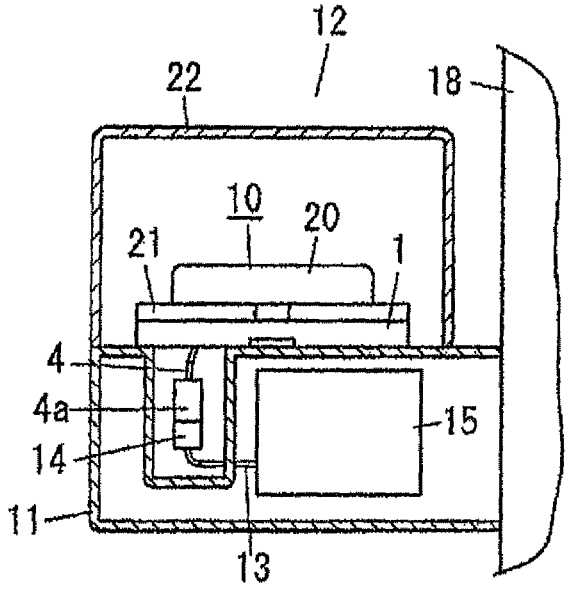
FIG. 11 is a sectional view of still another LED lighting fixture having the LED unit.

Further, the lighting fixture 12 having the construction shown in FIG. 11 is, for example, a bracket light of which the housing 11 is mounted to a wall 18. The housing 11 of this lighting fixture 12 is a box-shaped housing in which the power unit 15 is installed to be spaced apart from the housing 11. Further, in the housing 11, a diffusing plate 22 is mounted cover the LED unit 10, the diffusing plate 22 serving to diffuse and transmit light emitted from the cover 20 of the LED unit 10.

In the LED units 10 installed in the lighting fixtures 12 shown in FIGS. 9 to 11, the wires 4 are led to the side of second (the lower surface in FIG. 2) of the base 1 through the wire lead mouth 1*c* of the base 1, as shown in FIG. 2.

Figure 12:
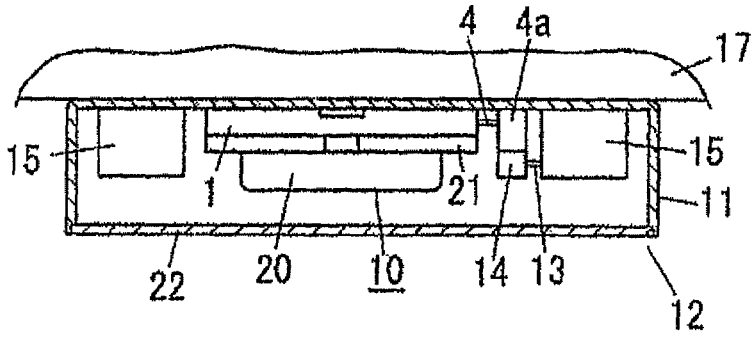
FIG. 12 is a sectional view of still another LED lighting fixture having the LED unit.
Figure 13:
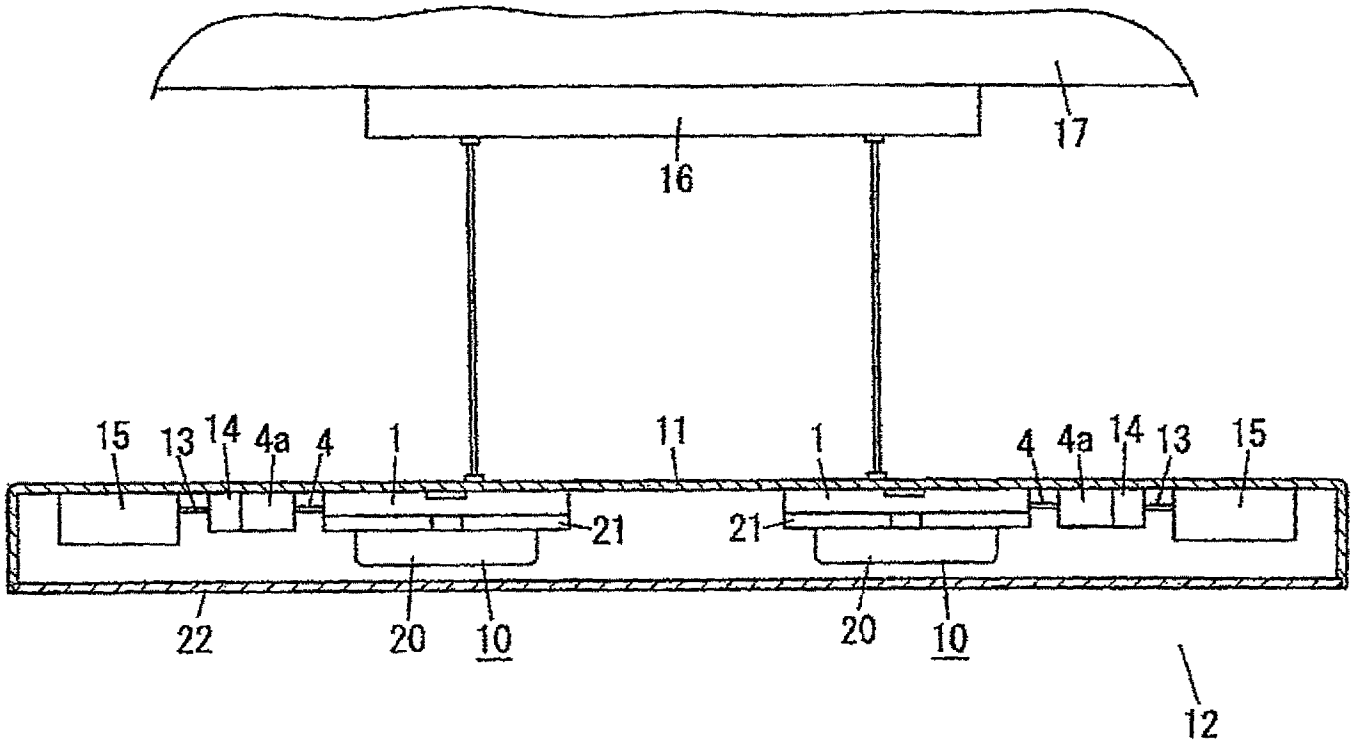
FIG. 13 is a sectional view of still another LED lighting fixture having the LED unit.
Figure 14:
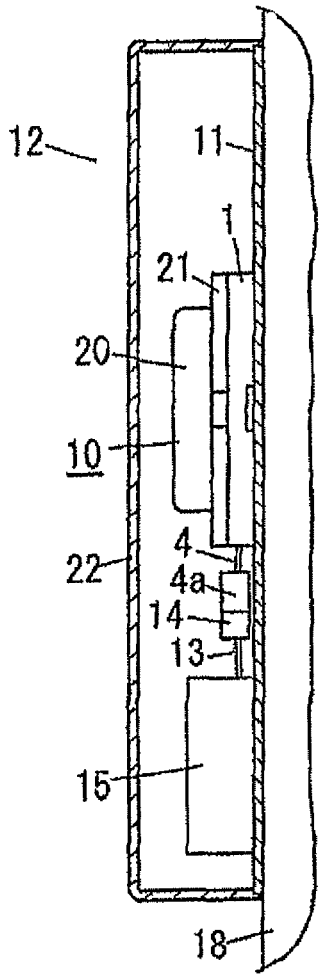
FIG. 14 is a sectional view of still another LED lighting fixture having the LED unit.
Figure 15:
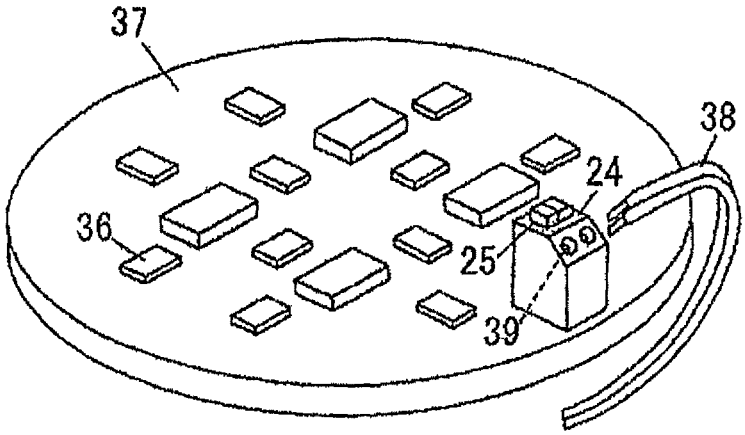
FIG. 15 (PRIOR ART)
FIG. 15 is a perspective view of an LED module board used in a conventional LED lighting fixture.

Further, the lighting fixture 12 having the construction shown in FIG. 12 is, for example, a ceiling light in which the power unit 15 is placed aside by the LED unit 10 and the housing 11 is mounted to the ceiling member 17. Further, the lighting fixture 12 having the construction shown in FIG. 13 is, for example, a pendant light of which the housing 11 is suspended from the a suspending unit 16 that is mounted to the ceiling member 17 and suspends the housing 11. Further, the lighting fixture 12 having the construction shown in FIG. 14 is, for example, a porch light in which the power unit 15 is placed below the LED unit 10 and the housing 11 is a longitudinal housing that is mounted to a wall 18. Further, each of the lighting fixtures 12 of FIGS. 12 to 14 has a diffusing plate 22 that diffuses and transmits light emitted from the cover 20 of the LED unit 10.

In the LED units 10 installed in the lighting fixtures 12 shown in FIGS. 12 to 14, the wires 4 are led to a lateral side (the left side in FIG. 2) of the base 1 through the wire lead mouth 1*c* of the base 1, as shown in FIG. 2. In these embodiments, the lighting fixtures 12 may be lighting fixtures that have LED units 10 capable of being mounted to a variety of housings 11.

While the invention has been shown and described with respect to the preferred embodiments, it will be understood by those skilled in the art that various changes and modifications may be made without departing from the scope of the invention as defined in the following claims:

What is claimed is:

1. An LED unit, comprising:

a plate-shaped base;

a light-emitting device placed on a surface of the base and including one or more LED chips; and a cover mounted to the base at a location above a front side of the light-emitting device and configured to transmit light emitted from the light-emitting device, wherein the base includes on the surface thereof an annular groove receiving a seal therein, and the cover includes on a surface thereof directed to the base an annular protruding part, the annular protruding part being inserted into the annular groove to seal the base and the cover through the seal, wherein a distance between the protruding part and the groove in a width direction of the groove is shorter in a section of the groove than other sections of the groove, and wherein the groove has a protruding portion protruding inward of the groove, the protruding portion being provided at the section of the groove, so that the distance between the protruding part and the groove in the width direction of the groove is shorter in the section of the groove than the other sections of the groove.

2. The LED unit of claim 1, wherein the groove has a circular ring shape.

3. A lighting fixture, comprising:

an LED unit described in claim 2; and a housing in which the LED unit is installed.

4. The lighting fixture of claim 3, wherein the protruding portion includes an inward protrusion formed on an outside circumferential surface of the groove while protruding inward of the groove, the inward protrusion being provided at the section of the groove.

5. The LED unit of claim 2, wherein the protruding portion includes an inward protrusion formed on an outside circumferential surface of the groove while protruding inward of the groove, the inward protrusion being provided at the section of the groove.

6. A lighting fixture, comprising:

an LED unit described in claim 1; and a housing in which the LED unit is installed.

7. The lighting fixture of claim 6, wherein the protruding portion includes an inward protrusion formed on an outside circumferential surface of the groove while protruding inward of the groove, the inward protrusion being provided at the section of the groove.

8. The LED unit of claim 1, wherein the protruding portion includes an inward protrusion formed on an outside circumferential surface of the groove while protruding inward of the groove, the inward protrusion being provided at the section of the groove.

* * * * *